US007275639B1

(12) United States Patent
Sillin

(10) Patent No.: US 7,275,639 B1
(45) Date of Patent: Oct. 2, 2007

(54) AMMUNITION CLIP PROTECTOR

(76) Inventor: David Sillin, 2570 Cremean Rd., Elida, OH (US) 45807

( * ) Notice: Subject to any disclaimer, the term of this patent is extended or adjusted under 35 U.S.C. 154(b) by 710 days.

(21) Appl. No.: 10/852,959

(22) Filed: May 26, 2004

(51) Int. Cl.
*F42B 39/02* (2006.01)

(52) U.S. Cl. ..... 206/3; 224/931; 383/118; 42/88

(58) Field of Classification Search ..... 42/88; 224/931; 383/118; 206/3
See application file for complete search history.

(56) References Cited

U.S. PATENT DOCUMENTS

| | | | | | |
|---|---|---|---|---|---|
| 900,093 | A | * | 10/1908 | Fisher | 206/3 |
| 900,095 | A | * | 10/1908 | Fisher | 206/3 |
| 1,113,590 | A | | 10/1914 | Williamson | |
| 1,210,377 | A | * | 12/1916 | Jennings | 224/682 |
| 3,066,791 | A | | 12/1962 | Bivens | |
| 4,214,686 | A | * | 7/1980 | Dostourian | 224/667 |
| D263,067 | S | | 2/1982 | Nichols | |
| 4,353,460 | A | * | 10/1982 | Kahn | 206/3 |
| D286,315 | S | * | 10/1986 | Gregory | D3/225 |
| 5,121,564 | A | | 6/1992 | Story | |
| 5,152,442 | A | | 10/1992 | Gallagher | |
| 5,174,482 | A | | 12/1992 | Rogers et al. | |
| 5,319,872 | A | * | 6/1994 | Bammate | 42/88 |
| 5,775,558 | A | | 7/1998 | Montalbano | |
| 5,924,565 | A | * | 7/1999 | Colee | 206/317 |
| D413,644 | S | | 9/1999 | Carver | |
| 6,076,715 | A | * | 6/2000 | Easter | 224/149 |
| 6,202,908 | B1 | | 3/2001 | Grover | |
| D465,918 | S | * | 11/2002 | Burdine | D3/262 |
| 6,675,693 | B1 | * | 1/2004 | Heayn | 89/34 |

* cited by examiner

*Primary Examiner*—Mickey Yu
*Assistant Examiner*—Jerrold Johnson

(57) ABSTRACT

An ammunition clip protector for protecting a gun from being scratched by an ammunition clip includes a first panel and a second panel. Each of the first and second panels is flexible and each has a bottom edge, a top edge, a first side edge and a second side edge. The first side edge of the first panel is attached to and extends along the first side edge of the second panel, and the second side edge of the first panel is attached to and extends along the second side edge of the second panel so that a sleeve is defined. The bottom edge of the first panel extends along and is attached the bottom edge of the second panel. The sleeve has an open upper end. An ammunition clip may be removably extended through the open upper end so that the ammunition clip is positioned within the sleeve.

6 Claims, 2 Drawing Sheets

AMMUNITION CLIP PROTECTOR

BACKGROUND OF THE INVENTION

1. Field of the Invention

The present invention relates to ammunition clip holding devices and more particularly pertains to a new ammunition clip holding device for positioning around an ammunition clip so that the clip may be positioned within a gun case without fear of the clip scratching the gun positioned within the gun case.

2. Description of the Prior Art

The use of ammunition clip holding devices is known in the prior art. U.S. Pat. No. 5,121,564 describes a pocket for holding an ammunition clip so that the clip may be attached to a firearm. Another type of ammunition clip holding device is U.S. Des. Pat. No. 413,644 which shows a pocket for holding a clip. The pocket is attachable to the stock of a firearm.

While these devices fulfill their respective, particular objectives and requirements, the need remains for a device that holds a clip so that it may be safely placed in a gun holding pouch without any danger of the clip scratching the gun. The device should also be easy to place on the clip and use a relatively small amount of space so that it easily fits in the pouch with the gun.

SUMMARY OF THE INVENTION

The present invention meets the needs presented above by generally comprising a first panel and a second panel. Each of the first and second panels is flexible and each has a bottom edge, a top edge, a first side edge and a second side edge. The first side edge of the first panel is attached to and extends along the first side edge of the second panel and the second side edge of the first panel is attached to and extends along the second side edge of the second panel so that a sleeve is defined. The bottom edge of the first panel extends along and is attached to the bottom edge of the second panel. The sleeve has an open upper end. An ammunition clip may be removably extended through the upper end so that the ammunition clip is positioned within the sleeve.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
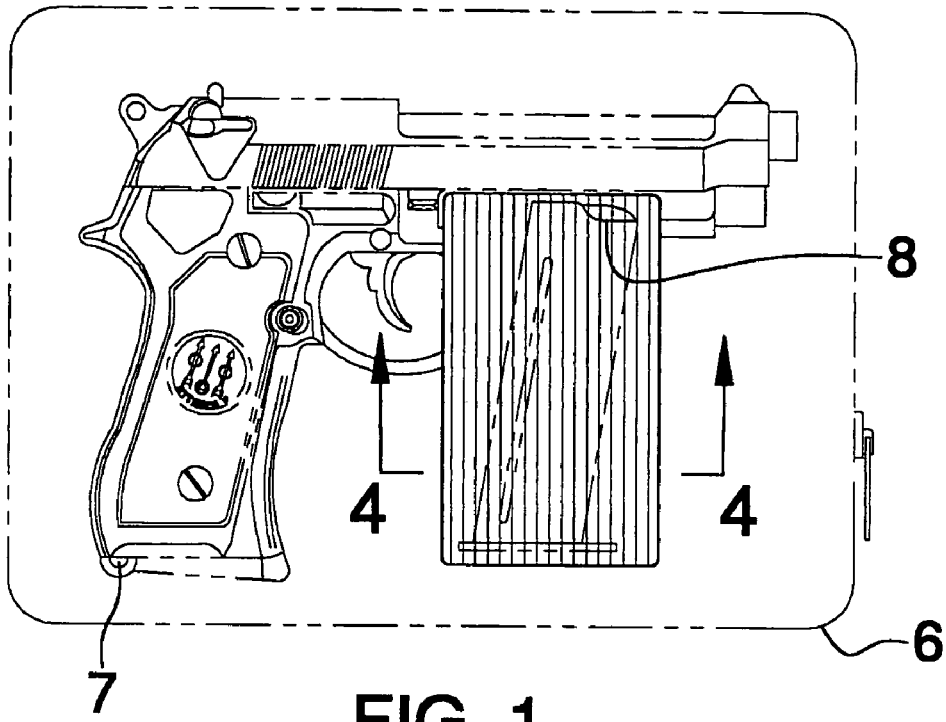
FIG. 1 is a front in-use view of a ammunition clip protector according to the present invention.
Figure 2:
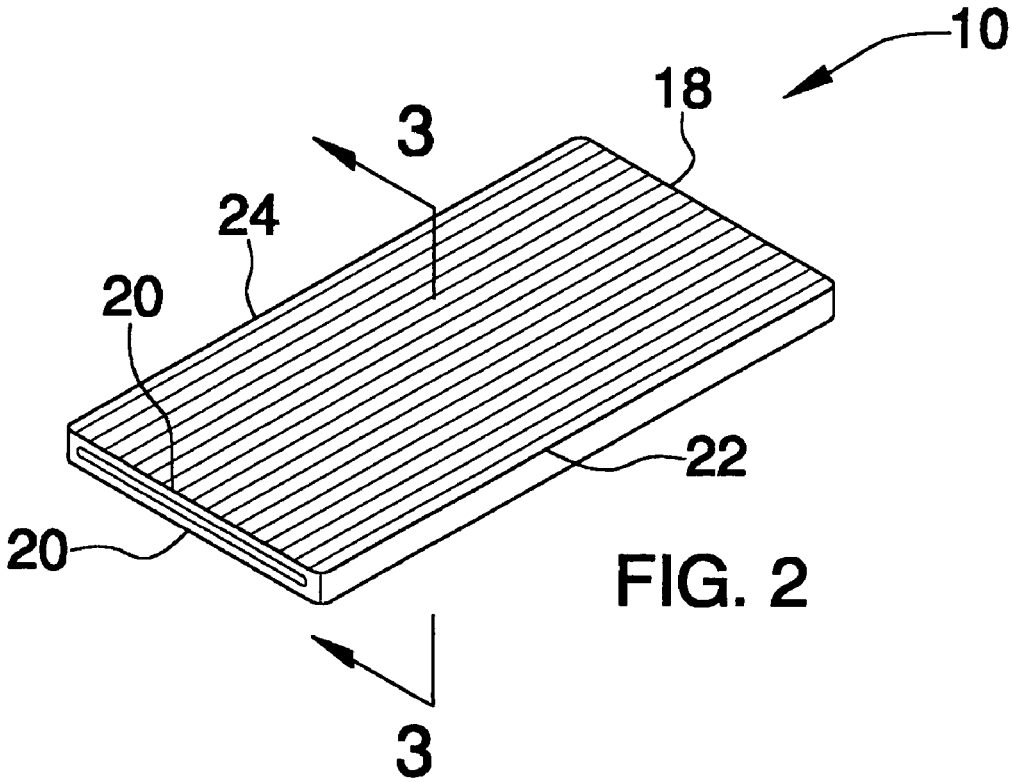
FIG. 2 is a perspective view of the present invention.
Figure 3:
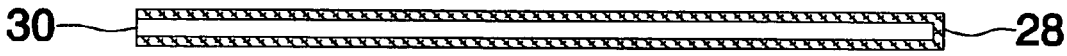
FIG. 3 is a cross-sectional view taken along line 3-3 of FIG. 2 of the present invention.
Figure 4:
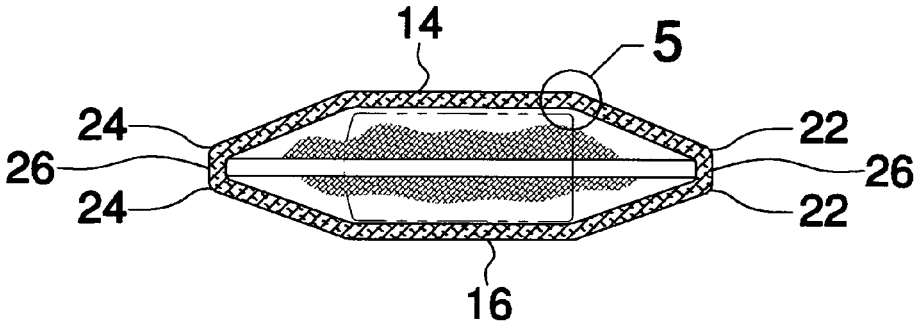
FIG. 4 is a cross-sectional view taken along line 4-4 of FIG. 1 of the present invention.
Figure 5:
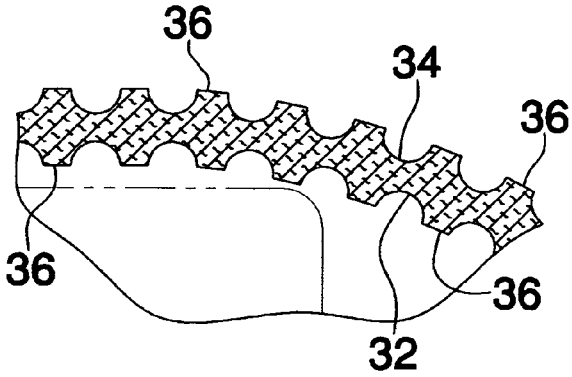
FIG. 5 is an enlarged view of the area designated "5" in FIG. 4 of the present invention.

With reference now to the drawings, and in particular to FIGS. 1 through 5 thereof, a new ammunition clip holding device embodying the principles and concepts of the present invention and generally designated by the reference numeral 10 will be described.

As best illustrated in FIGS. 1 through 5, the ammunition clip protector 10 generally comprises a first panel 14 and a second panel 16. Each of the first 14 and second 16 panels is flexible and each of the panels 14, 16 has a bottom edge 18, a top edge 20, a first side edge 22 and a second side edge 24. The first side edge 22 of the first panel 14 is attached to and extends along the first side edge 22 of the second panel 16 and the second side edge 24 of the first panel 14 is attached to and extends along the second side edge 24 of the second panel 16 such that a sleeve is defined. It is preferred that that juncture of the first 22 and second 24 edges be integral and walls 26 may formed at those junctures. Also, the bottom edge 18 of the first panel 14 extends along as is attached to the bottom edge 18 of the second panel 16 so that a closed bottom end 28 is defined. The juncture of the bottom edges 18 may also include a wall 26. The sleeve, or protector 10, has an open upper end 30.

Each of the panels 14, 16 comprises a resiliently stretchable material. The resiliently stretchable material comprises a cloth material has elastomer woven therein. Alternatively, the resiliently stretchable material may comprise an elastomer.

Each of the first 14 and second panels 16 has an inner surface 32 an outer surface 34. The inner 32 and outer 34 surfaces each have a plurality of ribs 36 thereon extending between respective ones of the top 20 and bottom 18 edges. The ribs 36 give the panels 14, 16 more flexibility and will allow the sleeve 10 to better conform to the shape of an ammunition clip 8.

The first 14 and second 16 panels each have a height from the top edges 20 to the bottom edges 18 generally between 6 inches and 8 inches. The panels 14, 16 have a width from the first side edges 22 to the second 24 side edges generally between 1½ inches and 3 inches. The sleeve 10 preferably has a depth from the outer surface 34 of the first panel 14 to the outer surface 36 of the second panel 16 generally less than ½ inch.

In use, an ammunition clip 8, and more particularly an ammunition clip for a pistol, may be removably extended through the upper end 30 so that the ammunition clip 8 is positioned within the sleeve 10. The clip 8 may then be positioned within a pistol carrying case 6 without fear that the metal from clip 8 will scratch the metal on the pistol 7. The clip 8 is slid from the sleeve 10 when the user decides to use it.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An ammunition clip holding and protecting device comprising:

a first panel and a second panel, each of said first and second panels being flexible, each of said panels having a bottom edge, a top edge, a first side edge and a second side edge, said first side edge of said first panel being attached to and extending along said first side edge of said second panel and said second side edge of said first panel being attached to and extending along said second side edge of said second panel such that a sleeve is defined, said bottom edge of said first panel extending along and being attached to said bottom edge of said second panel, said sleeve having an open upper end, each of said panels comprises a resiliently stretchable material, said resiliently stretchable material comprises a cloth material having elastomer woven therein, each of said first and second panels having an inner surface an outer surface, each of said inner and outer surfaces having a plurality of ribs thereon extending between respective ones of said top and bottom edges; and an ammunition clip removably extended through said upper end such that the ammunition clip is positioned within said sleeve.

2. The device according to claim 1, wherein said first and second panels having a height from said top edges to said bottom edges generally between 6 inches and 8 inches, said panels having a width from said first side edges to said second side edges generally between 1½ inches and 3 inches, said sleeve having a depth from said outer surface of said first panel to said outer surface of said second panel generally less than ½ inch.

3. A method of holding and protecting an ammunition clip comprising the steps of:

providing a first panel and a second panel, each of said first and second panels being flexible, each of said panels having a bottom edge, a top edge, a first side edge and a second side edge, said first side edge of said first panel being attached to and extending along said first side edge of said second panel and said second side edge of said first panel being attached to and extending along said second side edge of said second panel such that a sleeve is defined, said bottom edge of said first panel extending along and being attached to said bottom edge of said second panel, said sleeve having an open upper end, each of said panels comprising a resiliently stretchable material, said resiliently stretchable material comprising a cloth material having elastomer woven therein, each of said first and second panels having an inner surface an outer surface, each of said inner and outer surfaces having a plurality of ribs thereon extending between respective ones of said top and bottom edges; and extending an ammunition clip through said open upper end such that the ammunition clip is positioned within said sleeve.

4. The method according to claim 3, wherein said first and second panels having a height from said top edges to said bottom edges generally between 6 inches and 8 inches, said panels having a width from said first side edges to said second side edges generally between 1½ inches and 3 inches, said sleeve having a depth from said outer surface of said first panel to said outer surface of said second panel generally less than ½ inch.

5. An ammunition clip holding and protecting device comprising:

a first panel and a second panel, each of said first and second panels being flexible, each of said panels having a bottom edge, a top edge, a first side edge and a second side edge, said first side edge of said first panel being attached to and extending along said first side edge of said second panel and said second side edge of said first panel being attached to and extending along said second side edge of said second panel such that a sleeve is defined, said bottom edge of said first panel extending along and being attached to said bottom edge of said second panel, said sleeve having an open upper end, each of said panels comprises a resiliently stretchable material, said resiliently stretchable material comprising an elastomeric material, each of said first and second panels having an inner surface an outer surface, each of said inner and outer surfaces having a plurality of ribs thereon extending between respective ones of said top and bottom edges; and an ammunition clip removably extended through said upper end such that the ammunition clip is positioned within said sleeve.

6. The device according to claim 5, wherein said first and second panels having a height from said top edges to said bottom edges generally between 6 inches and 8 inches, said panels having a width from said first side edges to said second side edges generally between 1½ inches and 3 inches, said sleeve having a depth from said outer surface of said first panel to said outer surface of said second panel generally less than ½ inch.

* * * * *